United States Patent [19]

Kashio

[11] 4,110,966

[45] Sep. 5, 1978

[54] ELECTRONIC TIMEPIECE WITH STOP WATCH

[75] Inventor: Toshio Kashio, Tokyo, Japan

[73] Assignee: Casio Computer Co., Ltd., Tokyo, Japan

[21] Appl. No.: 753,279

[22] Filed: Dec. 22, 1976

[30] Foreign Application Priority Data

Dec. 26, 1975 [JP] Japan ..... 51-158625
Dec. 26, 1975 [JP] Japan ..... 51-158638

[51] Int. Cl.[2] ..... G04F 3/06

[52] U.S. Cl. ..... 58/4 A; 58/39.5; 58/58

[58] Field of Search ..... 58/4 A, 23 R, 38 R, 58/39.5, 58

[56] References Cited

U.S. PATENT DOCUMENTS

| | | | |
|---|---|---|---|
| 3,686,880 | 8/1972 | Samejima | 58/39.5 |
| 3,795,099 | 3/1974 | Tsuruishi | 58/23 R |
| 3,834,153 | 9/1974 | Yoda et al. | 58/38 R |
| 3,854,277 | 12/1974 | Samejima et al. | 58/39.5 |
| 3,934,400 | 1/1976 | Nishimura et al. | 58/23 R |
| 4,010,603 | 3/1977 | Forsyth | 58/39.5 |
| 4,023,345 | 5/1977 | Imamura | 58/39.5 |

*Primary Examiner*—Robert K. Schaefer

*Assistant Examiner*—Vit W. Miska

*Attorney, Agent, or Firm*—Flynn & Frishauf

[57] ABSTRACT

An electronic timepiece comprises a first time counting circuit including a time counter and adapted to count reference clock signals of an oscillator as time data at all times, and a time interval counting circuit provided independently of the time counting circuit and adapted to perform the function of a stopwatch based on a time count start instruction and time count stop instruction. The timepiece further includes a control circuit in which a minute/hour data and a date data are selectively displayed by the operation of a first switch on a digital type indicator and when the timepiece functions as a stopwatch a time interval data is displayed by the operation of a second switch on the indicator based on the time count start instruction and time count stop instruction. The control circuit has additional functions that, while the timepiece functions as a stopwatch, a normal minute/hour data from the time counting circuit can be switched by the operation of the first switch to a minute/hour time interval data (stopwatch) for display on the indicator and after display of the minute/hour time interval data a time interval data corresponding to a second or less can be displayed by the operation of the first switch on the indicator.

8 Claims, 1 Drawing Figure

ELECTRONIC TIMEPIECE WITH STOP WATCH

BACKGROUND OF THE INVENTION

This invention relates to a date display type electronic timepiece capable of functioning as a stopwatch.

With the advent of a digital display type electronic timepiece a variety of compact wristwatches of such type have been devised. Such wristwatches are adapted to display time data corresponding to minutes and hours on a display section made of a liquid crystal, LED etc. An attempt is made to display a date data on the display section. In this case, a date data is displayed on the display section by the operation of a display changeover switch. An attempt is also made to incorporate, in addition to such functions, other functions such as the function of a stopwatch into the wristwatches. It is necessary in this case to give a time count start instruction and time count stop instruction and display an involved time interval on the display section. Such a time interval needs to be displayed on a time or date display section in view of a limited display space. When the wristwatch performs the function of a wristwatch, if a long time interval is involved, there arises a necessity for reading a normal time data on the same wristwatch. As a result, many change-over switch mechanisms are required to effect a time count control and display changeover control, providing a bar to the miniaturization of the wristwatch.

It is accordingly the object of this invention to provide an electronic timepiece which can readily and effectively perform a date display function and a stopwatch function selectively, and also normal as corresponding time data on the same display section, as required, through the control of two switches. This is a great merit when the timepiece is made compact as in the case of a wristwatch.

SUMMARY OF THE INVENTION

According to this invention there is provided an electronic timepiece comprising on oscillator for generating reference clock signals; a frequency divider for frequency dividing the reference clock signals from the oscillator to generate time counting signals; a time counting circuit including a calender data counter and adapted to count at all times the time counting signals of the frequency divider as a normal time data; a time interval counting circuit provided independently of the time counting circuit and adapted to perform the function of a stopwatch based on a time count start instruction and a time count stop instruction; a digital type indicator for selectively displaying a minute/hour data or a date data corresponding to the time count data of the time counting circuit and a minute/hour data or a second or less data corresponding to the time interval of the time interval counting circuit; first and second switches for causing desired functions to be selectively displayed on the indicator; and a control circuit in which a normal minute/hour data is switched upon closure of the first switch to a date data corresponding to the output of the calendar date counter for display on the indicator, the minute/hour data or date data is switched to a time interval data based on a time count start instruction and time count stop instruction issued upon the repetative operation of the second switch, and after the display of the time interval data a second or less time interval data from the time interval counting circuit can be displayed upon the operation of the first switch on the indicator.

The electronic timepiece according to this invention can display a date data on the indicator through the control of the two switches and provide a great merit when the timepiece is made compact as in the case of a wristwatch.

BRIEF DESCRIPTION OF THE DRAWING

The single FIGURE is a block circuit diagram showing one embodiment of this invention.

DETAILED DESCRIPTION

Figure 1:
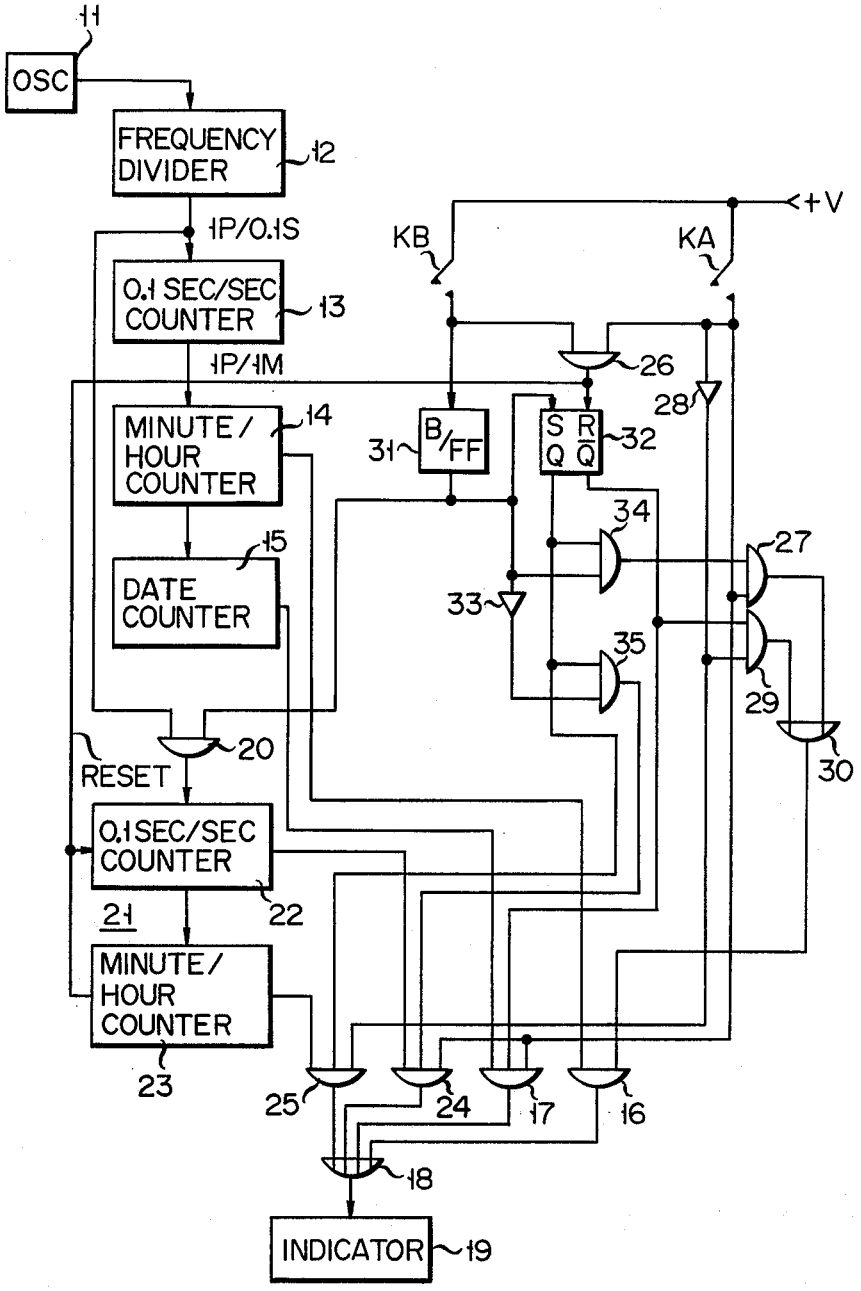

In the drawing a reference clock signal is generated from an oscillator 11. The reference clock signal is properly frequency divided at a frequency divider 12 to produce, for example, a one pulse 0.1 second (1P/0.1S) clock signal. The clock signal of the frequency divider 12 is supplied as a count step signal to a second counting circuit 13 comprised of, for example, scale of 10 and scale of 60 counters. The second counting circuit 13 produces a one pulse per second (1P/1M) output signal. The 1P/1M signal of the second counter 13 is supplied as a count step signal to a time counting circuit 14 comprised of a scale of 60 and scale of 12 counters etc. The time counting circuit 14 provides a minute and hour indication. For example, a one pulse per 24 hours (1P/24H) carry signal is generated from the time counting circuit 14. The carry signal of the time counting circuit 14 is fed to a date counting circuit 15 from which is generated, for example, a count signal representative of "a month", "a date" and "a day of the week".

The count signals of the counting circuits 14 and 15 are supplied to AND circuits 16 and 17 and the output signals of the AND circuits 16 and 17 are supplied, as a display signal, through an OR circuit 18 to a digital type indicator 19 having a display section indicating a time unit of "an hour" and "a minute".

The 1P/0.1S signal of the frequency divider circuit 12 is coupled as a count step signal through an AND circuit 20 to a smaller time unit counting circuit 22 which constitutes a time count circuit for performing the function of a stopwatch. A carry signal from the counting circuit 22 is coupled as a count step signal to a greater time unit counting circuit 23. The counting circuits 22 and 23 are constructed in the same way as the second counting circuit 13 and time counting circuit 14. That is, the counting circuit 22 is adapted to count the time in smaller time units of 0.1 to 60 seconds while the gate of the AND circuit 20 is opened and the counting circuit 23 is adapted to count the time in greater time units of minutes and hours. The count signals of the counting circuits 22 and 23 are supplied to AND circuits 24 and 25, respectively, and the outputs of the AND circuits 24 and 25 are coupled through the OR circuit 18 to the indicator 19 so as to function as a stopwatch.

An electronic timepiece includes a first switch KA of auto-return type which is opened during a normal time counting period and closed to select a specific function, and a second switch KB for a stopwatch. These switches generate a +V signal upon closure. A signal generated upon the closure of the first switch KA is coupled to the AND circuits 17 and 24 and to AND circuits 26 and 27 and inverter 28. When the switch KA is opened, the inverter 28 produces an output signal. The output of the inverter 28 is coupled as a gate signal to AND circuits 25 and 29. The outputs of the AND gates 27 and 29 are coupled to an OR 30 and the output of the OR circuit 30 is supplied as a gate signal to the AND circuit 16.

A signal generated upon the closure of the second switch KB is supplied as an inversion trigger signal to a binary flip-flop 31 adapted to invert the above-mentioned signal for each operation of the switch KB. The above-mentioned signal is also connected to the AND circuit 26. The AND circuit 26 is adapted to generate an output signal upon the simultaneous operation of the switches KA and KB and the output of the AND circuit 26 is supplied as a reset instruction to the time counting circuit 21 and to an RS flip-flop 32. The binary flip-flop 32 is set when the binary flip-flop 31 produces an output "1". The output "1" of the binary flip-flop 31 is supplied as a gate signal to the AND circuit 20. The set output of the flip-flop 32 is applied as a gate signal to the AND circuit 25. The output of the binary flip-flop 31 is also coupled through an inverter 33 to one gate of the AND circuit 35, and the output of the binary flip-flop 31 and the set output of the flip-flop 32 are coupled to an AND circuit 34. The set output of the flip-flop 32 is also coupled to the AND circuit 35. The output of the AND circuit 34 is connected to the AND circuit 27 and the output of the AND circuit 35 is connected to the AND circuit 24. The reset output of the flip-flop circuit 32 is connected to the AND circuits 29 and 27.

When the electronic timepiece functions as a normal timepiece, not as a stopwatch, the binary flip-flop 31, flip-flop 32 and time counting circuit 21 are all in the reset state, the second counting circuit 13 is counting the time in units of a second and the time counting circuit 14 is counting the time as units of minutes and hours. In this state, the flip-flop 32 is in the reset state and an output signal of the AND circuit 29 is supplied through the OR circuit 30 to the AND circuit 16. In consequence, a time count signal of the time counting circuit is supplied to the indicator 19 where the time is being displayed.

When the date is to be displayed on the same indicator 19, the first switch KA is closed. Since the inverter 28 produces an output "0", the gate of the AND circuit 29 is closed and the gate of the AND circuit 16, to which the minute/hour count signal is coupled, is closed, interrupting a time display on the indicator 19. At the same time, the gate of the AND circuit 17 is opened and a time count signal of the date counting circuit 15 is coupled to the indicator 19, thus effecting a date display on the indicator 19. That is, the time and date are selectively displayed on the indicator 19 in response to the closure of the first switch KA and the timepiece is used as a normal timepiece having a date display.

Where the timepiece is to be used as a stopwatch, the second switch KB is closed with the first switch KA in the open state. The binary flip-flop 31 is set to cause the gate of the AND circuit 20 to be opened. A clock signal of the frequency divider 12 is delivered to the time count circuit 21. That is, upon the closure of the second switch KB the timepiece starts to function as a stopwatch. At the same time the set output of the flip-flop 31 causes the flip-flop 32 to be set, supplying a gate signal to the AND circuit 25. Since at this time the output of the inverter 28 is "1" with the first switch KA in the open state, the gate of the AND gate 25 is opened, a time count signal of the greater time unit counting circuit is coupled to the indicator 19, effecting a minute/-hour time display. When in this state the second switch KB is again operated, the output of the binary flip-flop 31 is reversed. That is, the binary flip-flop 31 produces an output "0". The gate of the AND circuit 20 is closed, thus stopping the time counting operation of the time counting circuit 21. That is, the timepiece functions as a stopwatch and a start/stop operation is so repeated. Since at this time the flip-flop 32 is being set by the initial operation of the second switch KB, the count value of the minute/hour time counting circuit 23 in the start/stop time counting circuit 21 is displayed on the indicator 19.

While the timepiece is working as a stopwatch, if a long time interval is involved, there arises the necessity of reading an actual time during the time counting period. Since the time is read with the binary flip-flop 31 in the set state and the gate of the AND circuit 20 in the open state, the user closes the first switch KA. Since at this time the flip-flop circuit 32 is set, the set output of the flip-flop circuit 32 is coupled as a gate signal to the AND circuit 27 through the AND circuit 34. Upon the closure of the first switch KA the AND circuit 27 generates an output signal to cause the gate of the AND circuit 16 to be opened. Since the inverter 28 produces an output "0", the gate of the AND circuit 25 is closed, a time count signal of the minute/hour counting circuit 14 is coupled to the indicator 19 for time display, while the time counting circuit 21 continues its time counting operation. That is, upon the closure of the first key KA a time display can be effected on the indicator 19 without interrupting the stopwatch function. In this case, the time display is effected in time units of minutes and hours. However, there arises the necessity of effecting a time display in a smaller time unit of a second and 0.1 second. Where a smaller time unit is to be displayed on the indicator 19, the first switch KA is closed under the condition that the above-mentioned time counting is completed and the result of counting is held in the time counting circuit 21. That is, the first key switch KA is closed when the flip-flop 31 is in the reset state and the flip-flop circuit 32 is in the set state. In this state, the inverter 33 produces an output "1" and the AND gate 35 generates an output. Simultaneously with the closure of the first key switch KA the gate of the AND circuit 25 is closed and the gate of the AND circuit 24 is opened. That is, a signal of the smaller time unit counting signal is coupled to the indicator 19, effecting a time display in time units of a second and 0.1 second.

If in this state the electronic timepiece is to be used as a normal timepiece, the first and second switches KA and KB are simultaneously operated. Then, the AND circuit 26 produces an output signal, and the flip-flop 32 and time count circuit 21 are reset by the output of the AND circuit 26. At this time, the output of the binary flip-flop 31 becomes zero.

Although in the above-mentioned embodiment the clock signal counting circuit is used for time display and time counting, any counting means such as a combination of a memory means and adding means may be employed as such. This invention can be modified in a variety of ways without departing from the spirit and scope of this invention.

What is claimed is:

1. An electronic timepiece comprising a time data counting means for counting reference clock signals as time count data at all times; display means for displaying the time count data of said time data counting means; calendar data counting means for counting carry signals from said time data counting means; a display changeover switch operated to effect a switch from the time count data to a calendar data from the calendar data counting means so as to permit the latter to be coupled to the display means; time counting means provided independently of said time data counting means and said calendar data counting means and adapted to count reference clock signals; switch instruction means for giving a time count start instruction and time count stop instruction to said time count means; means for preferentially coupling the count value of said time counting means to said display means based on an instruction from said switch instruction means; detection means for detecting an in-operation state of said time counting means; and display control means for causing the counting value of said time count means to be switched to the time count data of said time data counting means for display on said display means when said display changeover switch is operated during the detection of the in-operation state by said detection means.

2. An electronic timepiece according to claim 1, wherein said switch instruction means includes a switch, and further including reset means for resetting said time counting means when said display changeover switch and said switch of said switch instruction means are simultaneously operated.

3. An electronic timepiece according to claim 2, in which when said time counting means is reset by said reset means a time count data from said time data means is coupled to said display means for display.

4. An electronic timepiece according to claim 1, wherein said timepiece is a wristwatch.

5. An electronic timepiece comprising a time data counting means for counting reference clock signals at all times; display means for displaying the time count data of said time data counting means; calendar data counting means for counting carry signals from said time data counting means; display changeover switch operated to effect a switch from the time count data to a calendar data from said calendar counting means so as to permit the latter to be coupled to said display means; time counting means provided independently of said time data counting means and calendar data counting means and adapted to count reference clock signals, said time counting means comprising a greater time unit counting section and a smaller time unit counting section; switch instruction means for giving a count start instruction and count stop instruction to said time counting means; means for preferentially coupling a count value of said greater time unit counting section to said display means based on an instruction from said switch instruction means; means for detecting that said changeover switch is operated when the counting operation of said time counting means is stopped; and display control means for causing count contents of the smaller time unit counting section in said time counting means to be displayed on said display means through detection of said detecting means.

6. An electronic timepiece according to claim 2, wherein said switch instruction means includes a switch, and further including reset means for resetting said time counting means when said display changeover switch and said switch of said switch instruction means are simultaneously operated.

7. An electronic timepiece according to claim 5, in which when said time counting means is reset by said reset means, a time count data from said time data means is coupled to said display means for display.

8. An electronic timepiece according to claim 2, wherein said timepiece is a wristwatch.

* * * * *